US006074336A

United States Patent [19]

Purvey

[11] Patent Number: 6,074,336

[45] Date of Patent: Jun. 13, 2000

[54] SEPARATOR WITH CONTROL VALVE AND INTERLOCK DEVICE

[75] Inventor: Ronald J Purvey, Axminster, United Kingdom

[73] Assignee: The Glacier Metal Company Limited, Middlesex, United Kingdom

[21] Appl. No.: 09/142,637

[22] PCT Filed: Mar. 7, 1997

[86] PCT No.: PCT/GB97/00619

§ 371 Date: Sep. 10, 1998

§ 102(e) Date: Sep. 10, 1998

[87] PCT Pub. No.: WO97/34703

PCT Pub. Date: Sep. 25, 1997

[30] Foreign Application Priority Data

Mar. 19, 1996 [GB] United Kingdom ..... 9605735

[51] Int. Cl.[7] ..... B04B 9/06

[52] U.S. Cl. ..... 494/49; 494/64

[58] Field of Search ..... 494/5, 7, 24, 36, 494/42, 43, 49, 60, 64, 65, 84, 901; 210/130, 133, 168, 171, 232, 234, 235, 360.1, 416.5, 418, 420, 421

[56] References Cited

U.S. PATENT DOCUMENTS

| | | | |
|---|---|---|---|
| 2,373,349 | 4/1945 | Serrell . | |
| 3,432,091 | 3/1969 | Beazley | 494/49 |
| 3,784,092 | 1/1974 | Gibson . | |
| 4,032,451 | 6/1977 | Rosaen | 210/232 |
| 4,106,689 | 8/1978 | Kozulla . | |
| 4,165,032 | 8/1979 | Klingenberg . | |
| 4,221,323 | 9/1980 | Courtot . | |
| 4,379,053 | 4/1983 | Brane | 210/234 |
| 4,492,631 | 1/1985 | Martin | 494/901 |
| 4,498,898 | 2/1985 | Haggett | 494/49 |
| 4,557,831 | 12/1985 | Lindsay et al. | 210/232 |
| 4,871,458 | 10/1989 | Purvey | 210/360.1 |
| 5,096,581 | 3/1992 | Purvey | 210/232 |
| 5,334,309 | 8/1994 | Huggett et al. | 210/133 |
| 5,674,392 | 10/1997 | Christophe et al. | 494/49 |
| 5,904,841 | 5/1999 | Penny | 210/130 |

FOREIGN PATENT DOCUMENTS

| | | | |
|---|---|---|---|
| 0254356 A2 | 1/1988 | European Pat. Off. . | |
| 1151222 | 7/1963 | Germany | 494/49 |
| 43 11 906 | 10/1994 | Germany . | |
| 145089 | 1/1962 | U.S.S.R. | 494/49 |
| 1158242 | 5/1985 | U.S.S.R. | 494/49 |
| 278161 | 10/1927 | United Kingdom . | |
| 386465 | 1/1933 | United Kingdom . | |
| 735658 | 8/1955 | United Kingdom . | |
| 876299 | 8/1961 | United Kingdom . | |
| 1 089 355 | 11/1967 | United Kingdom . | |
| 1089355 | 11/1967 | United Kingdom . | |
| 2120134 | 11/1983 | United Kingdom . | |
| 2204510 | 11/1988 | United Kingdom . | |
| 92/16303 | 10/1992 | WIPO | 494/49 |
| WO 96 23589 | 8/1996 | WIPO . | |

OTHER PUBLICATIONS

WPI Abstract Acc No. 84–102490/17 & DE3308368 C Junker.

*Primary Examiner*—Charles E. Cooley
*Attorney, Agent, or Firm*—Nixon & Vanderhye P.C.

[57] ABSTRACT

A centrifugal separator (FIG. 1) has a base adapted to be mounted to a surface of a machine, such as an engine, with internally communicating high pressure liquid lubricant supply and low pressure drain passages. The base includes a control valve to inhibit supply to the rotor via spindle so that the cover and rotor can be removed whilst the base is still connected to the source of high liquid pressure. The valve takes the form of an aperture containing a valve body rotatable by handle to close the supply passage or (FIG. 2) create a diversion passage directly to the drain passage. An interlock device may be provided to impede cover removal with the valve open and/or impede accidental closure of the valve.

15 Claims, 2 Drawing Sheets

SEPARATOR WITH CONTROL VALVE AND INTERLOCK DEVICE

TECHNICAL FIELD

This invention relates to liquid cleaning arrangements of the type including a centrifugal separator of solid contaminants from a liquid passed through a container thereof rotated at high speed, and in particular relates to mounting and maintaining of such centrifugal separator with respect to a machine in which said liquid is contained and flows.

BACKGROUND

It is well known to remove solid contaminants of all sizes from a fluid, frequently a liquid, by a centrifugal separator in which a substantially vertically-mounted, high speed rotor includes a contaminant-depositing container, (more conveniently referred to simply as a contaminant container) through which the fluid is passed and in which solid contaminants are separated from the fluid to deposit on the container wall from which they can be periodically removed or the container replaced. Such a centrifugal cleaner may have its rotor driven by external coupling to an engine or like rotary plant with which used, which results in a complex and expensive arrangement, or may, as is more usual, be driven by causing the fluid applied to the contaminant container under pressure to exit by way of tangentially directed nozzle means, the reaction to which spins the rotor at high speed essential for efficient centrifugal separation. Such a fluid-cleaner, in which the rotor is driven by the fluid being cleaned, is what is referred to herein as a self-powered centrifugal separator.

Such self-powered centrifugal separators are used with internal combustion engines of a variety of types and sizes to effect separation of particulate contaminants from lubricating oil circulated through components of any engine by way of ducts formed within the engine block. Examples of such cleaners are to be found in GB 735658, GB 1089355 and GB 2193123.

Self-powered centrifugal separators are, by definition, by-pass devices in which any lubricating oil which is supplied at substantially the same pressure as to other engine components passes through, and effects rotation of, the contaminant container by losing all of its energy in the process and is able only to return to a collecting reservoir of the engine under gravity. Such separators are therefore always employed in combination with conventional full-flow barrier filters by way of which the lubricant is pumped at high pressure to the working components of the engines, and a proportion of this lubricant is directed to the centrifugal cleaner.

Traditionally an engine block has been made with a prepared region adapted to receive a filter assembly thereon, and with ducts surfacing at such regions for supplying lubricant to, and taking it from the filter assembly. The area of engine block surface that is available for mounting an additional centrifugal separator is small and hitherto emphasis has been placed on providing a maximum cross-sectional area for a drain duct, so that lubricant can drain freely under gravity, while providing the high pressure supply through an external, but exposed, line.

It is known to make cleaning assemblies incorporating both full-flow barrier filters and self-powered centrifugal separators in a single mounting arrangement, having a carrier manifold or block which is mounted on, and forms the interface for liquid passage with, the engine block. Examples of these are given in GB 876299, GB 2160449 and GB 2160796. However, in many engine designs, having existing simple, full-flow filter provisions, it is preferable to have separately mounted full-flow filter and centrifugal separator.

One of the benefits of employing a centrifugal separator is that the container can operate for long intervals before it becomes filled with sediment requiring the container to be cleaned or replaced. However, even though its operation is not essential to continual operation of the engine, at least in the short term, due to the lubricant by-passing the working components of the engines, it is still necessary with traditional designs to clean or replace the container at regular maintenance times when the engine is stopped, notwithstanding that the container of the centrifugal separator may not need attention (such attention requires removal of a cover containing the container and replacement of any seals etc.)

Because the lubricant path through the arrangement by-passes that supplying the engine components, it should be possible to remove, clean and/or change the contaminant container whilst the engine runs, but when the container is rotating at high speed and ejecting lubricant within the cover this is clearly extremely undesirable. Furthermore, as it is usually a simple matter to determine when a container has stalled, that is ceased to rotate, through becoming filled with sediment, there is the possibility of an operative removing the cover in order to remove the stationary container without realizing or remembering that the inlet to the container is connected to the source of high pressure lubricant for the engine. Such inadvertent removal of the rotor would not only discharge lubricant about the exterior of the engine but also starve the engine components of more lubricant than is normally by-passed by the separator.

The danger to engine functionality posed by uncontrollable release of lubricant is, of course, also compromised by any high pressure liquid supply line, exposed externally of the engine, becoming damaged.

Thus whereas such self-powered centrifugal separator arrangements operate for long intervals without attention, their presence may involve a small but quantifiable risk of engine damage through accident or inadvertent operation not connected with the functioning of the separator per se.

Notwithstanding that such an engine is just one example of a machine in which liquid, such as a lubricant, is circulated by pump pressure and requires separation of particulate contaminants, it is an object of the present invention to provide, for a machine in which a liquid such as lubricating oil is circulated through internal supply and drain ducts, a self-powered centrifugal separator which offers improved operational functionality and safety than arrangements known hitherto.

SUMMARY OF THE INVENTION

According to a first aspect of the present invention a self-powered centrifugal separator of solid contaminants from a liquid lubricant, adapted to be operably mounted against a mounting surface of a machine in which said liquid lubricant is circulated by pumping from a reservoir, comprises i) a base having a first surface thereof adapted to be mounted in an operable disposition against a said mounting surface of a machine and a second surface arranged with respect to said first surface to lie, with said first surface so mounted, to be generally upwardly facing, ii) a liquid drain passage extending through the base from a collection region in said second surface to a surface other than the second surface, iii) spindle means extending from said second surface of the base along an operably substantially vertical axis above the collection region and containing an axially extending spindle passage, iv) a rotor, supported on the spindle means for rotation thereabouts, having an annular contaminant container in communication with the spindle passage and, by way of reaction nozzle means, with the collection region, said annular contaminant container being operable in response to receipt of said pumped liquid lubricant from the spindle means at elevated pressure and ejection thereof from the reaction nozzle means to effect rotation about the spindle means at such speed as to separate said solid contaminants from the liquid lubricant within the contaminant container, v) a removable cover supported on the base and enclosing the rotor and collection region, vi) a liquid lubricant supply passage extending through the base between said spindle passage and a surface other than said second surface, and vii) control valve means operable to permit contemporaneously with supply of pumped liquid lubricant at said elevated pressure to the supply passage in the base removal of the rotor.

According to a second aspect of the present invention, a machine in which a liquid is circulated includes pump means to develop a circulating pressure in the liquid, a mounting surface and a centrifugal separator as defined in the preceding paragraph mounted on the mounting surface.

In a preferred machine arrangement the mounting surface includes a supply and/or drain passage for the liquid and the centrifugal separator is mounted thereon with the supply and/or drain passage thereof in communication with a corresponding passage in the mounting surface.

Embodiments of the invention will now be described by way of example with reference to the accompanying drawings.

DETAILED DESCRIPTION OF THE DRAWINGS

Figure 1:
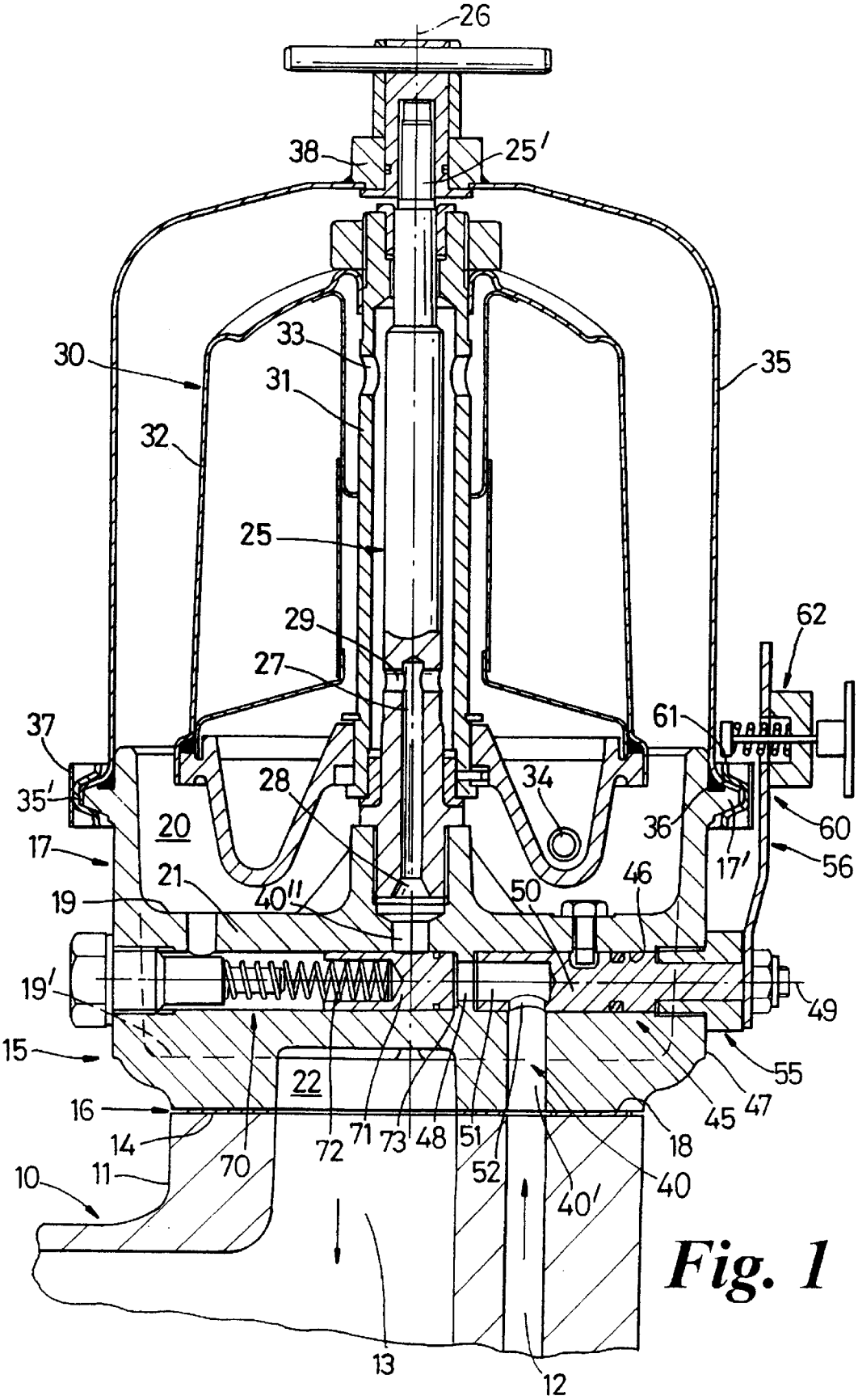
FIG. 1 is a sectional elevation through a fragment of a machine in which lubricating oil is circulated, having high-pressure supply and low-pressure drain ducts therein opening at a substantially horizontal mounting surface, and a centrifugal separator in accordance with the invention mounted on said mounting surface, by way of a base incorporating a liquid inhibiting valve means, FIG. 2(*a*) is a sectional elevation through a fragment of a modified form of centrifugal separator illustrating a different form of valve means in a valve-open disposition, and FIG. 2(*b*) is a sectional elevation similar to FIG. 2(*a*) but showing the valve means in a valve-closed disposition.

Referring to FIG. 1 a machine 10, such as an internal combustion engine of conventional design, has a block 11 housing moving components which are lubricated by a liquid lubricant, oil, which is pumped through ducts cast or drilled into the block and which also serve to return used lubricant at atmospheric pressure to a sump or other reservoir. Duct 12 is a small diameter, high pressure passage connected to receive liquid substantially at pump pressure and duct 13 is a large diameter, atmospheric pressure drain duct connected to the sump. The ducts 12 and 13 both open to a substantially flat, horizontal mounting surface 14 on which is mounted a centrifugal separator 15, by way of an intermediate sealing gasket 16.

The centrifugal separator 15 comprises a base 17 having a first surface 18 adapted to be mounted against the horizontal mounting surface 14 by way of the gasket 16 and a second surface 19, on the opposite side of the base, which is generally upwardly facing and recessed to form a collection region 20 which, out of the plane of the drawing, extends closer towards the first surface as delineated by broken lines 19' and straddling a central, thicker region 21. A drain passage 22 extends through the base from the collection region 20 to the first surface 18 and, with the base mounted, communicating with the drain duct 13.

Spindle means 25 comprises a static spindle fixed to, and extending from, the second surface 19 in the central region 21 along an operably, that is mounted, substantially vertically extending axis 26 above the collection region. The spindle contains an axially extending spindle passage 27 open at one end 28 thereof towards the base and at the other end by way of lateral cross-drillings 29 in the spindle wall.

A rotor 30 supported on the spindle for rotation thereabout comprises a bearing tube 31 extending along, and surrounding, the spindle and arranged to receive liquid from the spindle passage by way of cross drillings 29. The bearing tube also supports, and defines therearound, an annular contaminant container 32, which container is in liquid flow communication with the spindle passage by way of apertures 33 in the bearing tube and is in communication with the collection region 20 by way of tangentially directed reaction nozzle means 34 formed in the base of the container.

A removable cover 35 encloses the rotor and collection region, being supported on the base 17 by way of outwardly projecting sealing flanges 35' and 17' on each respectively and between which is disposed in sealing element 36. The sealing flanges 35' and 17' are tapered convergingly in a radial direction and surrounded by a correspondingly profiled, circumferentially discontinuous clamping ring arrangement 37 which, by radial contraction, is operable to provide significant axial sealing force on the sealing element. The upper part of the cover surrounds the upper end part 25' of the spindle and is secured, exerting a limited axially-directed pressure on the sealing element 36, by a nut arrangement 38.

A liquid supply passage 40 extends through the base between the end 28 of the spindle passage and said first surface 18, the supply passage, in a manner analogous to drain passage 22, communicating with the duct 12 in the mounting surface 17 of the machine block.

The base 17 also has control valve means, indicated generally at 45 which will be described in detail below.

Apart from the control valve means, operation of the separator is substantially conventonal. The drain duct 13 and drain passage 22 are of large cross-section and define an ambient pressure within the cover and collection region at the same pressure as the machine sump, that is, atmospheric pressure. Liquid lubricant, delivered at elevated pressure by duct 12 enters and traverses the base 17 in supply passage 12, passes along the spindle duct 27 and enters the contaminant container 32 of the rotor, wherein the pressure of the liquid is substantially at supply pressure. Liquid is forced from the container by way of reaction nozzle means 34 and collects in the collection region 20 from whence it drains by way of passage 22 and duct 13, the pressure drop across the reaction nozzle means causing sufficient reaction to rotate the rotor at a high rate required to separate particulate contaminants from the liquid passing through the container 32.

It will be appreciated that the supply of liquid at elevated pressure takes place through a supply passageway 40 totally contained within the base 17 and not susceptible to accidental damage.

It will also be appreciated that it is possible for the contaminant container to become filled by separated contaminants and cease rotating, that is, stall. As outlined above, because the centrifugal separator inherently operates in a by-pass mode its lack of operation for any reason, including maintenance, does not per se depend upon stopping the machine. Accordingly, there exists a risk of an operative removing the cover from a stalled rotor only to discover that after the rotor is displaced, possibly as a result of supply pressure, the liquid is discharged at high pressure to the detriment of the operative and machine, possibly starving functioning elements of the machine of lubrication.

The control valve means 45 is operable to permit removal of the rotor contemporaneously with supply of the liquid to the supply passage 40 in the base, notwithstanding the elevated pressure due to the machine being in operation, and operates to inhibit supply of liquid to the spindle passage at 28. In this embodiment the control valve means is operable to block the supply passage to the passage of liquid.

The control valve means 45 comprises a valve aperture 46 extending through the base, in particular the thickened central region 21, from a third surface 47 of the base and intersecting the supply passage 40, thereby defining a portion 48 of the supply passage which extends along the axis 49 of the aperture between a first section 40' of the supply passage, which extends from the aperture of the first surface 18, and a second section 40" of the supply passage which extends from the aperture to the spindle passage.

A valve body 50 extends along the passageway and is displaceable with respect thereto between a valve-open position (shown) in which it permits passage of liquid to the spindle passage and a valve-closed position in which it inhibits the supply of liquid to the spindle passage.

The valve aperture and valve body are circular in cross-section and the valve body is rotatable about the common longitudinal axis 49 to effect the displacement between valve-open and valve-closed positions. The valve body is disposed in the aperture such that it closes off the supply passage section 40' from the section 48, but it has passageways therein, in the form of an axially extending recess 51 and a transverse aperture 52 aligned with the end passage section 40', such that in the illustrated rotational position the valve body permits-free flow of liquid into the aperture portion 48 and supply passage section 40" whereas in other rotational positions the supply passage is blocked.

An end part 55 of the valve body extends from the valve aperture at the third surface 47 of the base and provides means by which the valve body may be rotatably displaced, handle means 56 being secured to this end part to permit manual displacement.

It will be seen that by movement of the handle means to rotate the valve body to a valve-closed position, supply of liquid to the spindle passage is blocked at the cover 35 and rotor 32 may be safety removed.

To ensure that the cover is not inadvertently removed when the rotor has merely stalled and not as a result of operating the control valve means, interlock means, indicated generally at 60, is provided to impede removal of the cover whilst the valve means is supplying liquid to the spindle passage, that is, when the valve body 50 is in the valve-open position.

To this end the cover has a projection conveniently provided at 61 by the clamping ring arrangement 37 of the cover defining an upwardly facing shoulder. The handle means 56 extends from the valve body above the level of the projection and carries displaceable abutment means 62, arranged to overlie the shoulder. The interlock means, comprising the abutment means and handle means, thus functions to impede radial expansion of the clamping ring arrangement, and thus upward removal of the cover, unless the abutment means is displaced from the overlying position by rotation of the handle means and of the valve body from its valve-open position. Although the abutment means may be passive, in the sense that rotation of the handle causes it to cease overlying the projection with no further action, it is convenient to require a manual operation to end such overlying relationship, which has the additional effect of preventing the valve body being moved from a valve-open position, or possibly put into a valve-closed position, without deliberate action.

Optionally, and as shown, the valve means 45 may include a cut-off valve 70 which is responsive to liquid pressure below a predetermined minimum level to prevent liquid from being delivered from the spindle passage. Most conveniently, such cut-off valve is disposed in the base and closes the supply passage 40. As shown, the cut-off valve 70 is disposed in valve aperture 46 and comprises a piston 71 extending along the aperture and overlying the end of the section 40" of the supply passage, being biased by spring 72 towards the valve body and restrained by a shoulder 73. In response to liquid pressure in excess of said minimum level required to overcome the bias of spring 72, the piston is displaced to permit liquid passed by the valve body to enter the spindle passage. The use of such a cut-off valve per se is known for preventing liquid lubricant from passing through the rotor and by-passing the main lubrication paths when the supply pressure is too low to sustain rotation. In the present embodiment, the cut-off valve may also provide an effective seal to liquid delivery to the spindle passage when the valve body is in the valve-closed position without placing stringent sealing constraints on the valve body itself. That is, provided the valve body provides sufficient closure to present a suitably large pressure drop across it, some leakage past the body may be tolerated and the cut-off valve effect the sealing.

It will be appreciated that many variations may be made in respect of the presence or absence of features such as cut-off valve and interlock means as well as to the forms taken thereby if present. The relative disposition of valve body and cut-off valve in respect of the sequence in which supplied liquid encounters them may also be reversed.

Likewise, variation may be made as to the means by which the valve body is displaced, whether it be manual or by some powered mechanism, and the nature of the displacement itself, such as rectilinearly instead of, or in addition to, rotation. For example, the ability to translate as well as rotate the valve body may be incorporated into the interlock means such that the abutment means and handle are displaced along the direction of aperture axis 49 from a projection-overlying position whence the handle can be rotated to place the valve body into a stable valve-closed position.

In the above described embodiment, the control valve means operates simply to impede the flow of liquid through the by-pass circuit effected by the centrifugal separator. In some circumstances the supply pressure of the liquid to all parts of the machine 10 may be interrelated in accordance with the resistances met by the various flow paths, and it may be undesirable to upset the relationship by simply blocking the supply passage.

Figure 2A:
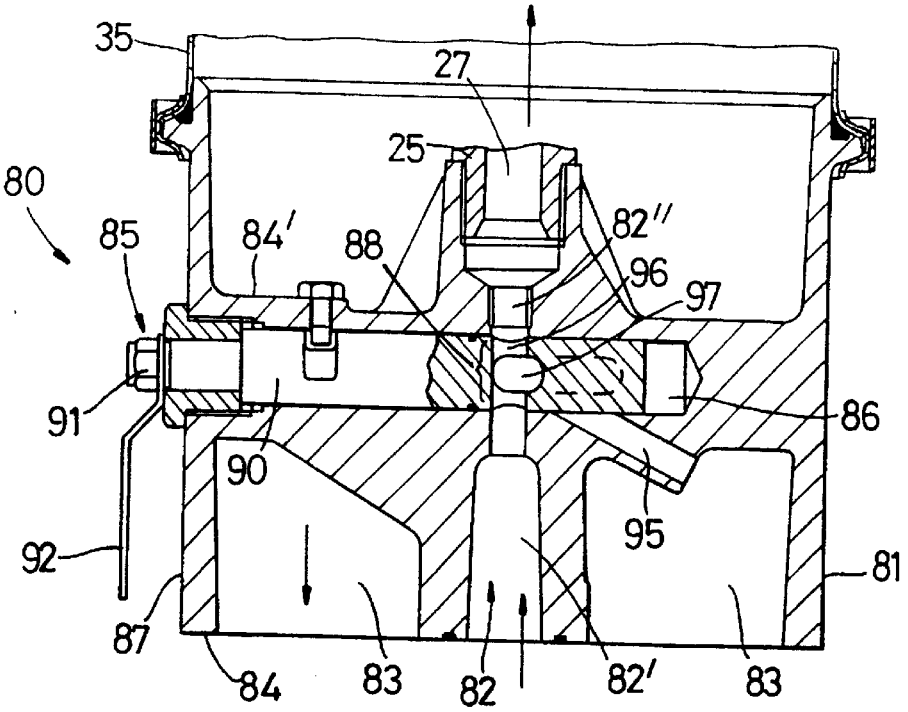
Figure 2B:
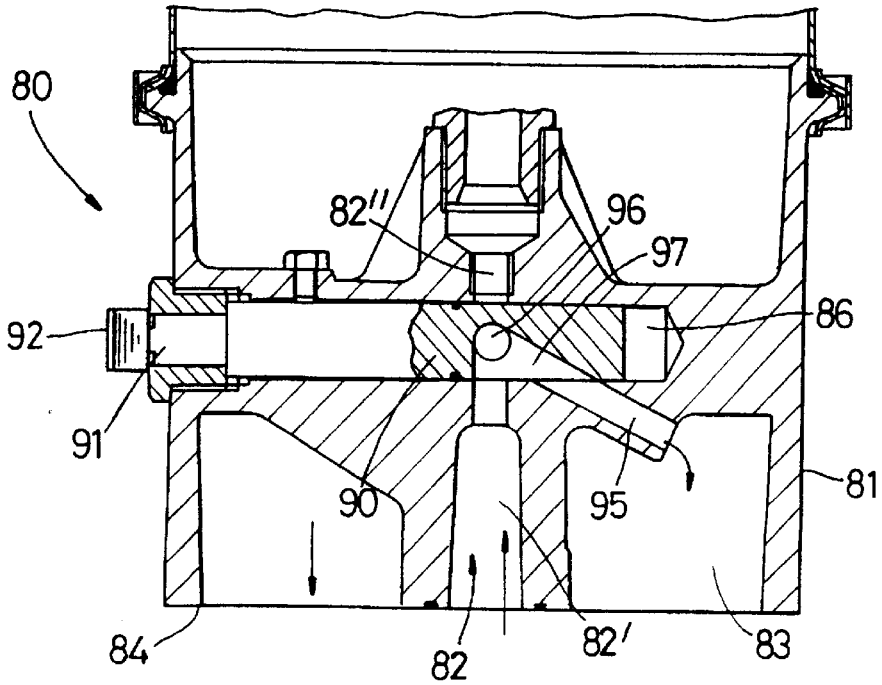

Referring to FIGS. 2(*a*) and 2(*b*), a second form of centrifugal separator 80 is shown in part, the parts not shown or shown in full being as described above.

The base 81 differs in detail from the base 7 described above most particularly in that the supply passage 82 is centrally disposed and coaxially surrounded by drain passage 83, both opening into the operationally downwardly facing and horizontal first surface 84 on the opposite side of the body to upwardly facing second surface 84'.

The control valve means, indicated generally at 85, comprises a valve aperture 86 extending through the base from third surface face 87 and intersecting the supply passage to define a portion 88 thereof by the width of the valve aperture.

The valve aperture contains a rotatable valve body 90 extending axially thereof, through the portion 88 which intersects the supply passage and terminates at end part 91 outwardly of the third surface of the base, to which end part a handle 92 is secured.

The valve aperture portion 88 separates the supply passage into sections 82', communicating with the first surface 84 and 82" communicating, with the spindle passage. A diversion passage 95 is also defined through the base joining the valve aperture with drain passage 83.

The valve body 90 has a transverse through-aperture 96 which, in the valve-open position of the valve body shown in FIG. 2(*a*) connects sections 82' and 82" of the supply passage, and, in a perpendicular plane has a notch 97 which, in the valve-closed orientation of the valve body shown in FIG. 2(*b*) connects supply passage section 92' with diversion passage 95.

In this arrangement 80, when the valve body is moved to the valve-closed position, the liquid continues to flow into the by-pass circuit offered by the centrifugal separator arrangement but is returned directly to the drain passage permitting the cover and rotor to be removed.

It will be appreciated that this embodiment may also have the valve body configured for translational motion instead of, or in addition to, rotational rotation. Furthermore, it may also include interlock means to prevent inadvertent removal of the cover and/or operation of the valve means and/or it may include a cut-off valve to prevent low-pressure supply of liquid to the rotor.

It will be appreciated that the presence of a diversion path relaxes the requirement for an efficient sealing mechanism to prevent leakage to the spindle passageway when the valve body is in a valve-closed position. It may be possible to have the two sections 92' and 92" of the supply passage permanently connected, by way of a pressure-responsive cut-off valve if appropriate, and rely upon reduction in pressure by way of diversion of the flow in the valve-closed position to effect inhibition of supply of liquid to the spindle passage.

It will be appreciated that the valve means or any part of it may be disposed other than in the base, parts being disposed remotely of the base or in the spindle means extending from the base.

The mounting surface of the machine with which a centrifugal separator according to the invention is used may, of course, not be horizontal, so that the first surface of the base would then not be horizontal nor oppositely disposed with respect to the second surface.

Furthermore, notwithstanding the operable orientation of the first surface, the drain passage and/or supply passage need not both emerge for connection to the machine at the first surface 18 or 84 by which the base is operably mounted with respect to a machine and with any passage lined up in communication with corresponding ducts in the mounting surface.

I claim:

1. A self-powered centrifugal separator of solid contaminants from a liquid lubricant, adapted to be operably mounted against a mounting surface of a machine in which said liquid lubricant is circulated by pumping from a reservoir, said separator comprising i) a base having a first surface adapted to be mounted in an operable disposition against said mounting surface of said machine, and a second surface arranged with respect to said first surface to lie, with said first surface in said operable disposition, to be generally upwardly facing, ii) a liquid drain passage extending through the base from a collection region in said second surface to a surface other than said second surface, iii) spindle means extending from said second surface of the base along an operably substantially vertical axis above the collection region and containing an axially extending spindle passage, iv) a rotor, supported on said spindle means for rotation thereabout, having an annular contaminant container in communication with the spindle passage and, by way of reaction nozzle means, with the collection region, said annular contaminant container being operable in response to receipt of said pumped liquid lubricant from the spindle means at elevated pressure and ejection thereof from the reaction nozzle means to effect rotation of the annular contaminant container about the spindle means at such speed as to separate said solid contaminants from the liquid lubricant within the contaminant container, v) a removable cover supported on the base and enclosing the rotor and collection region, vi) a liquid lubricant supply passage extending through the base between said spindle passage and a surface other than said second surface, and vii) control valve means within said base operable to inhibit passage of liquid lubricant to said spindle passage to permit removal of the rotor contemporaneously with supply of pumped liquid lubricant at said elevated pressure to the supply passage in the base, and wherein the control valve means comprises a valve aperture extending through the base intersecting, and defining a portion of, said supply passage, a valve body extending along the valve aperture and displaceable with respect thereto between a valve-open position in which it permits free passage of liquid to said spindle passage and a valve-closed position in which it inhibits supply of liquid to the spindle passage; and further wherein an end part of the valve body extends from the aperture at a third surface of the base and the valve body is displaceable by said end part and further comprises interlock means operable to impede removal of the cover while the valve means is supplying liquid to the spindle passage, said interlock means comprising a projection of the cover defining an upwardly facing shoulder and displaceable abutment means arranged to overlie said shoulder to impede removal of the cover from the base by abutment therewith, said displaceable abutment means being coupled to said end part of the valve body whereby displacement of said displaceable abutment means from an overlying position is associated with displacement of the valve body from a valve-open position.

2. A self-powered centrifugal separator as claimed in claim 1 wherein an end part of the valve body extends from the aperture at a third surface of the base and the valve body is displaceable by said end part and in which, with the valve body disposed in the valve open position, and wherein said control valve means includes handle means coupled to said end part of the valve body and arranged to permit manual displacement of the valve body, the handle means extending from said end part of the valve body above the position of said upwardly facing shoulder of the cover and said displaceable abutment means of the interlock means includes said handle means.

3. A self-powered centrifugal separator as claimed in claim 1 in which the valve body is disposed in said valve aperture to close off the supply passage between said portion and the first surface of the base in both said valve-open and valve-closed positions thereof, said valve body having at least one passageway therein operable to communicate with said supply passage and spindle passage in the valve-open position.

4. A self-powered centrifugal separator as claimed in claim 1 in which the valve body has a passageway therein operable to communicate with said supply passage and drain passage in the valve-closed position.

5. A self-powered centrifugal separator as claimed in claim 1 in which an end part of the valve body extends from the aperture at a third surface of the base and the valve body is displaceable by said end part.

6. A self-powered centrifugal separator as claimed in claim 5 in which the control valve means includes handle means coupled to said end part of the valve body and arranged to permit manual displacement of the valve body.

7. A self-powered centrifugal separator as claimed in claim 1 in which the control valve means includes a cut-off valve disposed between said valve body and the spindle passage and responsive to liquid pressure below a predetermined minimum level to close the supply passage.

8. A self-powered centrifugal separator as claimed in claim 7 in which the valve aperture defines a said portion of the supply passage extending along the axis of the aperture, the valve body is arranged in its valve-open position to deliver liquid to said axially extending aperture portion and the cut-off valve comprises a piston, extending along said valve aperture and biased towards said valve body to close off said spindle passage from the valve aperture, responsive to liquid pressure in excess of said minimum level acting thereon to be displaced against the bias to permit the liquid to enter said spindle passage.

9. A self-powered centrifugal separator as claimed in claim 11 in which the control valve means is operable to connect the supply passage to the drain passage.

10. A self-powered centrifugal separator as claimed in claim 11 in which the control valve means includes a cut-off valve responsive to liquid pressure below a predetermined minimum level to close the supply passage.

11. A self-powered centrifugal separator as claimed in claim 1 in which the control valve means includes interlock means operable to impede removal of the cover whilst the valve means is supplying liquid to the spindle means.

12. A self-powered centrifugal separator as claimed in claim 1 in which said first surface of the base is substantially opposite to said second surface.

13. A self-powered centrifugal separator as claimed in claim 1 in which the supply passage opens to said first surface of the base.

14. A self-powered centrifugal separator as claimed in claim 13 in which the drain passage also opens to the first surface of the base.

15. A self-powered centrifugal separator of solid contaminants from a liquid lubricant, adapted to be operably mounted against a mounting surface of a machine in which said liquid lubricant is circulated by pumping from a reservoir, said separator comprising i) a base having a first surface thereof, adapted to be mounted in an operable disposition against said mounting surface of said machine, and a second surface arranged with respect to said first surface to lie, with said first surface so mounted, to be generally upwardly facing, ii) a liquid drain passage extending through the base from a collection region in said second surface to a surface other than said second surface, iii) spindle means extending from said second surface of the base along an operably substantially vertical axis above the collection region and containing an axially extending spindle passage, iv) a rotor, supported on said spindle means for rotation thereabout, having an annular contaminant container in communication with the spindle passage and, by way of reaction nozzle means, with the collection region, said annular contaminant container being operable in response to receipt of said pumped liquid lubricant from the spindle means at elevated pressure and ejection thereof from the reaction nozzle means to effect rotation of the annular contaminant container about the spindle means at such speed as to separate said solid contaminants from the liquid lubricant within the contaminant container, v) a removable cover supported on the base and enclosing the rotor and collection region, vi) a liquid lubricant supply passage extending through the base between said spindle passage and a surface other than said second surface, and vii) control valve means within said base, operable to inhibit passage of liquid lubricant to said spindle passage to permit removal of the rotor contemporaneously with supply of pumped liquid lubricant at said elevated pressure to the supply passage in the base, and wherein said control valve means further comprises interlock means operable to impede removal of the cover whilst the valve means is supplying liquid to the spindle means.

* * * * *